US007753014B2

(12) United States Patent
Fitzgerald

(10) Patent No.: US 7,753,014 B2
(45) Date of Patent: Jul. 13, 2010

(54) ELECTRO-HYDRAULIC VALVE ACTUATOR WITH INTEGRAL ELECTRIC MOTOR DRIVEN ROTARY CONTROL VALVE

(75) Inventor: John William Fitzgerald, Bradenton, FL (US)

(73) Assignee: Sustainable Energy Technology Development Trust, Sarasota, FL (US)

( * ) Notice: Subject to any disclaimer, the term of this patent is extended or adjusted under 35 U.S.C. 154(b) by 623 days.

(21) Appl. No.: 11/732,070

(22) Filed: Apr. 2, 2007

(65) Prior Publication Data

US 2007/0227478 A1 Oct. 4, 2007

Related U.S. Application Data

(60) Provisional application No. 60/788,783, filed on Apr. 3, 2006.

(51) Int. Cl.
*F01L 9/02* (2006.01)

(52) U.S. Cl. ..... 123/90.12; 123/90.11; 137/625.21; 251/129.11

(58) Field of Classification Search ..... 123/90.12, 123/90.13, 90.11; 137/625, 625.15, 625.65, 137/625.21; 251/65, 129.01, 129.11
See application file for complete search history.

(56) References Cited

U.S. PATENT DOCUMENTS 5,537,976 A * 7/1996 Hu ..... 123/322
5,692,464 A * 12/1997 Kimura ..... 123/90.15
7,559,300 B2 * 7/2009 Ruggiero ..... 123/90.12

* cited by examiner

*Primary Examiner*—Ching Chang

(57) ABSTRACT

An improved electro-hydraulic intake and exhaust valve actuator for a "camless" internal combustion reciprocating engine. The present invention integrates an electric motor driven "plug type" rotary control valve and a single acting hydraulic cylinder in one housing for the actuation of an engine valve. The geometry of the hydraulic ports in the rotary control valve may be tailored for desired valve actuation profiles. The electronic control of the rate of rotation and angular position of the rotary control valve are used to infinitely vary the engine valve operating parameters. Thus, engine valve timing, speed, cycle duration and lift may be varied. A rotary control valve permits high speed operation and accommodates a broad range of valve sizes. Availability of a wide range of commercial open frame brushless electric motors and dedicated integrated circuit controllers contribute to the cost effectiveness of the present design.

4 Claims, 10 Drawing Sheets

SECTION A - A

SECTION A - A

ELECTRO-HYDRAULIC VALVE ACTUATOR WITH INTEGRAL ELECTRIC MOTOR DRIVEN ROTARY CONTROL VALVE

CROSS-REFERENCE TO RELATED APPLICATIONS

The benefit of Provisional Application 60/788,783, filed Apr. 3, 2006 by the same named inventor, entitled "Electro-hydraulic valve actuator with integral electric motor driven rotary control valve" and of substantially the same subject matter, is hereby requested.

FEDERALLY SPONSORED RESEARCH OR DEVELOPMENT

Not Applicable

COMPACT DISC APPENDIX

Not Applicable

BACKGROUND OF THE INVENTION

Internal combustion reciprocating engine (ICRE) design has been in transformation for some time due to the demands for increased engine efficiency and lower emissions. Non-conventional fuel blends, and ultimately alternative fuels, are anticipated to come into increasing use. In response, engine designers have been re-examining engine attributes, including the actuation of the gas exchange valve (GEV), i.e. the intake and exhaust valve. In its present forms the ubiquitous poppet valve, with cam shaft actuation and coiled metal spring valve closure, are generally seen as inadequate for future engine requirements. Over the last several years there has been considerable effort expended on valve actuation (VA) as well as variable valve actuation (VVA) and a great number of patents have been issued in this area. Of these, the electro-hydraulic valve actuator (EHVA) is the focus the present invention. This class includes both the basic function of valve actuation (valve opening and valve closure) and variable valve actuation (varied valve timing, open/close duration and amount of valve lift).

Notable among the EHVA designs are the valve actuators disclosed by Sturman or its assignees—see: U.S. Pat. Nos. 7,025,326, 6,557,506, 6,360,728, 6,308,690, 6,148,778, 5,829,396, 5,713,316, 5,640,987, and 5,638,781. The foregoing patents are based primarily on the original Sturman design of a latching solenoid, disclosed in U.S. Pat. Nos. 3,743,898 and 3,683,239 (first applied to Diesel fuel injectors). This latching solenoid device is employed in the Sturman EHVA to move a linear hydraulic spool valve, which then provides hydraulic pressure and flow to an actuating hydraulic cylinder. In this design, as disclosed in U.S. Pat. No. 5,638,781, the valve operation is either open or closed. Quoting from its abstract: "—Energizing one solenoid moves the spool and valve into an open position. The valve spool is maintained in the open position by the residual magnetism of the valve housing and spool even when power is no longer provided to the solenoid. Energizing the other solenoid moves the spool and valve to a closed position. The solenoids are digitally latched by short pulses provide by a microcontroller. The valve is therefore opened by providing a digital pulse of a short duration to one of the solenoids and closed by a digital pulse that is provided to the other solenoid.—". That is, the valve is either fully open or fully closed. Sturman discloses, in U.S. Pat. No. 5,638,781, an EHVA with integrated double acting hydraulic cylinder (which eliminates the need for a GEV return spring) and digital solenoid spool valve. To add an additional degree of valve control, Sturman further discloses, in U.S. Pat. No. 7,025,326, a design and method which adds a proportional hydraulic control valve function, with the objective of reducing the power consumption of the valve actuation system. However, this addition has a higher degree of complexity and an associated cost increase compared to the "digital" version. Sturman valve actuators have demonstrated satisfactory on-engine performance and the introduction of a Sturman EHVA into a production truck engine is imminent. Nonetheless, the latching solenoid principle appears to be limited to relatively modest sized EHVA—due the required properties of the magnetic circuit.

Schechter discloses in U.S. Pat. No. 5,456,222 (assigned to Ford Motor company) a reversing electric motor with a threaded shaft coupled to a threaded hydraulic valve spool—to convert the motor rotary motion to linear motion for the reciprocation of the spool valve. The hydraulic spool valve produces reversible hydraulic fluid flow to an integral double acting actuating cylinder (no valve spring) for a GEV. The requirement for reversing the motor is a disadvantage as it degrades valve response compared to a motor with continuous rotation.

Eaton discloses in U.S. Pat. No. 5,682,846 an EHVA with solenoid spool valve and an integral double acting hydraulic cylinder actuator with dual pistons of two different diameters, providing greater actuation force onto the GEV—than similar prior devices.

Buehrle discloses in U.S. Pat. No. 6,024,060 a unique rotationally oscillating electric motor directly driving a hydraulic control valve supplying hydraulic fluid to a separate single acting hydraulic cylinder actuating the GEV.

Cummins discloses in U.S. Pat. No. 6,067,946 a device utilizing one or more hydraulic pressure sources applied through solenoid valves to a separate single acting hydraulic cylinder actuator for a GEV with varying return spring configurations.

Each of these inventors devices, Sturman, Schechter (Ford), Eaton, Cummins, and Buehrle, have limitations such as speed, operating range, capacity, cost, power consumption, etc.—which other designers are endeavoring to overcome. For example, see "Development of a Piezoelectric Controlled Hydraulic Actuator for a Camless Engine" Thesis of J. S. Brader, University of South Carolina, 2001—that demonstrated a successful proof of concept piezoelectric stack, hydraulic spool valve and actuator device. Also see: "Dynamic simulation of an electro-hydraulic open center gas-exchange valve actuator system for camless internal combustion engines." Thesis, J. M. Donaldson, P. E., Milwaukee School of Engineering, 2003—in which modeling of an open-center hydraulic series valve system demonstrated the feasibility of the concept.

The present invention is an electro-hydraulic valve actuator (EHVA) intended to provide a more optimal balance of the wide range of design aspects required of EHVA, including: capacity, speed, lift, profile, cost, etc.—thereby satisfying the requirements of a broader range of ICRE and providing an improvement over the existing EHVA art. It utilizes a rotary "plug" valve which has the potential for very high speed, (>10,000 rpm or 20,000 rpm engine speed) thus allowing the present invention to meet the speed requirement of any known ICRE. As a single acting actuator, the present invention's speed is however, ultimately limited by the valve spring. The present invention is scalable over the entire range of ICRE sizes from micro engines to the largest Diesel contemplated. In addition, the present invention may be implemented with a varying range of components to meet cost objectives—for example a switched reluctance motor versus a permanent magnet motor. The recent commercial availability of a wide range of brushless electric motors and dedicated integrated driver circuits has made the present invention viable. Nonetheless, it is unlikely there will be just one solution to improved ICRE valve actuation as the range of engine requirements is highly diverse.

SUMMARY OF THE INVENTION

The general objective is to provide variable valve actuation for the gas exchange valves of a "camless" ICRE. Electro-hydraulic valve actuators have shown to be able to provide far greater actuating force than competing valve actuation technology. Given the trends in ICRE operation, the GEV is expected to operate with greater pressures and at faster rates than in previous engines—which requires higher actuating force—thus the selection of an EHVA for the basis of the present invention. Furthermore, economics favor the use of a single acting hydraulic cylinder type actuator, as fewer actuator components are required versus a double acting cylinder. (Although valve springs are needed with a single acting cylinder they are a mature and cost effective component.) Integrating the actuating cylinder with the control valve has also shown to be cost effective and provides for the most compact geometry. Both features have been adopted for the present invention.

The present invention is an EHVA with a rotary valve and integral single acting linear hydraulic cylinder. Hydraulic pressure and flow to the hydraulic cylinder is controlled by an electric motor driver rotary "plug" valve (which may be incorporated into the motor shaft). The rotary "plug" valve is ported in such a manner that, to open the GEV, the high pressure hydraulic fluid—from an external pump—is directed from the EHVA inlet port to the hydraulic cylinder causing it to move linearly, which compresses the valve spring and opens the GEV. As the rotary valve is turned further, by the electric motor, the inlet port and valve port are no longer aligned and the pressure is retained in the hydraulic cylinder—thereby holding the GEV open. Additional rotation of the rotary valve aligns its port with the EHVA outlet port and pressure is relieved from the hydraulic cylinder and the valve spring forces the hydraulic cylinder piston to return to the original position closing the GEV and discharging the hydraulic fluid in the cylinder to the external pump return. The cycle repeats as long as the rotary valve is turned by the electric motor. The EHVA motor speed and angular position are controlled in such a manner as to match the ICRE speed and attain the desired valve timing, duration and lift. The present design is an improvement on existing designs in that it is scalable over a wide size range and capable of actuating the GEV at speeds greater than existing devices and is producible at a competitive cost.

DESCRIPTION OF THE PREFERRED EMBODIMENTS

Figure 1:
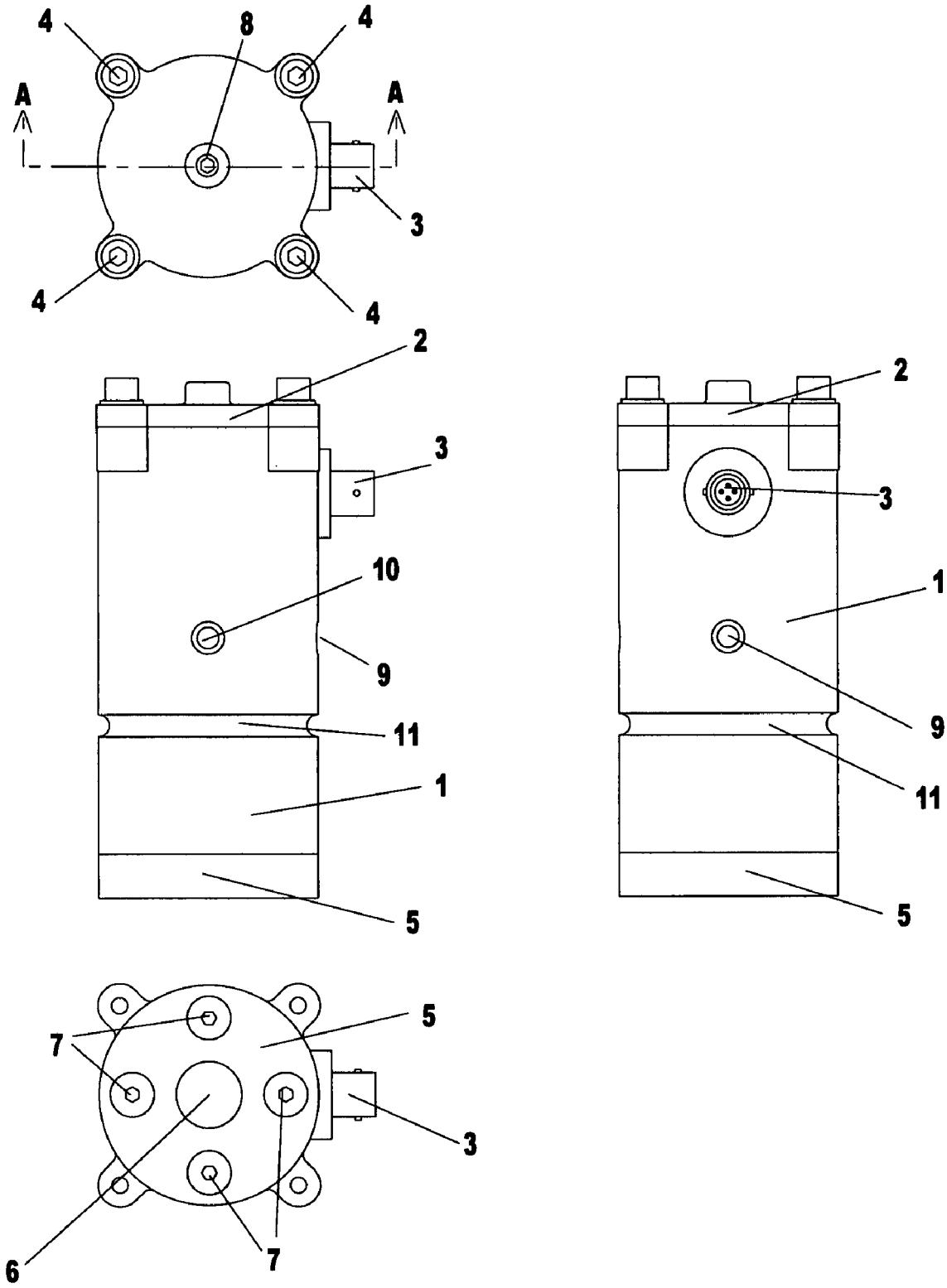
FIG. 1 shows the electro-hydraulic valve actuator assembly 1 in front, top, bottom, and right side views. It consists of valve top cap 2, valve body 25, electrical connector 3, valve bottom cap 5, and piston 6. Hydraulic fluid intake port 9 and hydraulic fluid outlet port 10 provide the means of supplying hydraulic pressure and flow into and out of, respectively, the electro-hydraulic valve actuator assembly 1.

Referring to FIG. 1, the electro-hydraulic valve actuator assembly 1 is shown in front, top, bottom and right side views.

Figure 5:
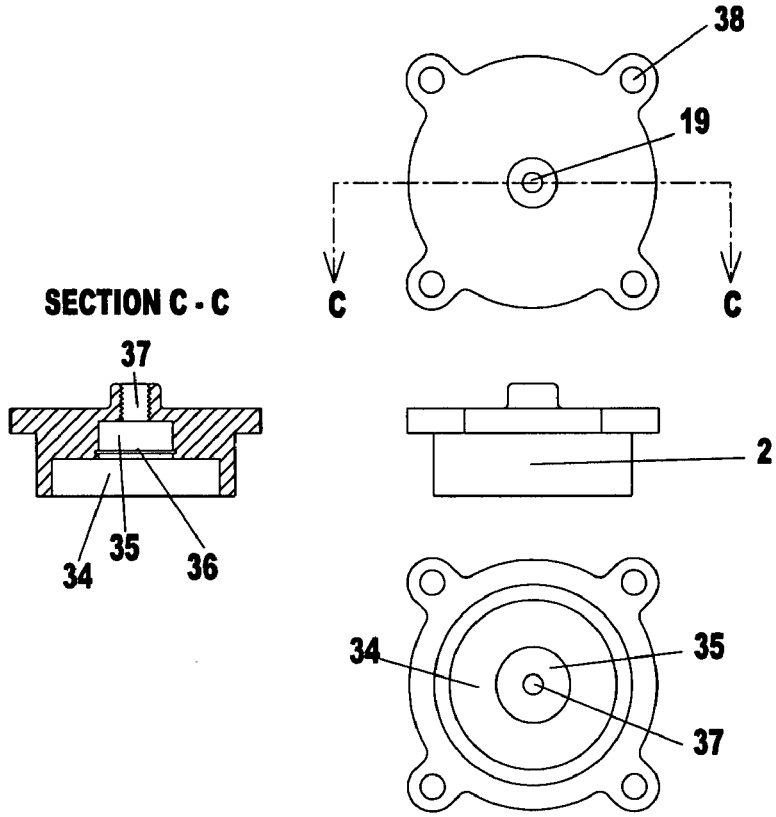
FIG. 5 shows valve top cap 2 in top, side, bottom and cross section views.

It consists of four major external components: valve body 25, valve top cap 2, valve bottom cap 5 and piston 6. Valve top cap 2 primarily provides the means of locating and securing internal components and sealing the valve body 25. Valve top cap 2 is fastened to valve body 25 by four (4) socket head cap screws 4 which are secured by four (4) lock washers 12 and is sealed with vent plug 8. (Alternatively, vent plug 8 may be removed and a "case drain" line connected.) Detail of valve top cap 2 may be seen in FIG. 5 which shows front, top, bottom views and cross section C-C. Note cross section C-C showing stator bore 34, bushing bore 35, retaining ring slot 36 and threaded hole 37. Also note fastener holes (4) 38 in the top view. See FIG. 6 for miscellaneous hardware items associated with valve top cap 2.

Figure 4:
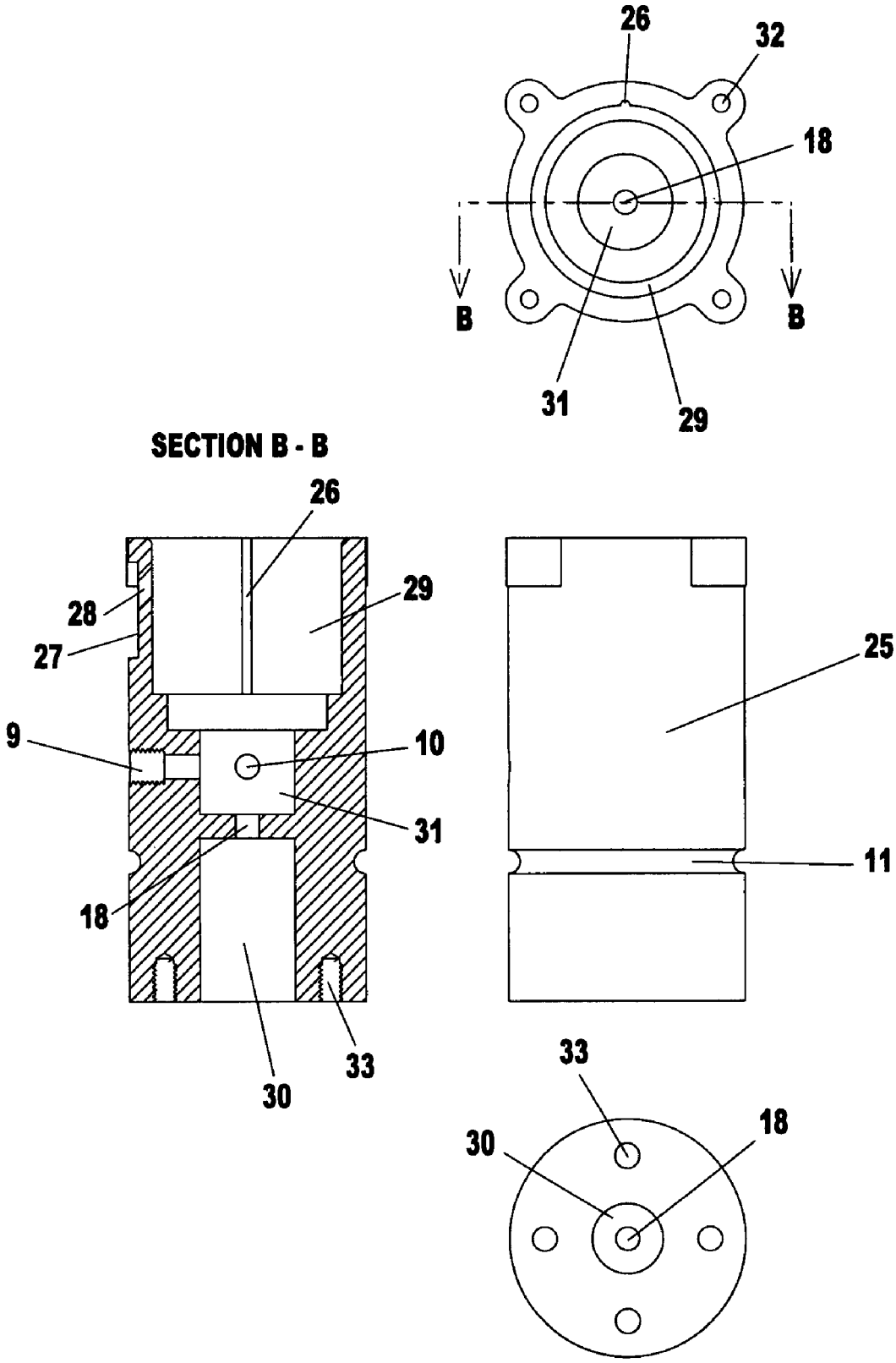
FIG. 4 shows valve body 25 which is the main housing of the electro-hydraulic valve actuator assembly 1.
Figure 7:
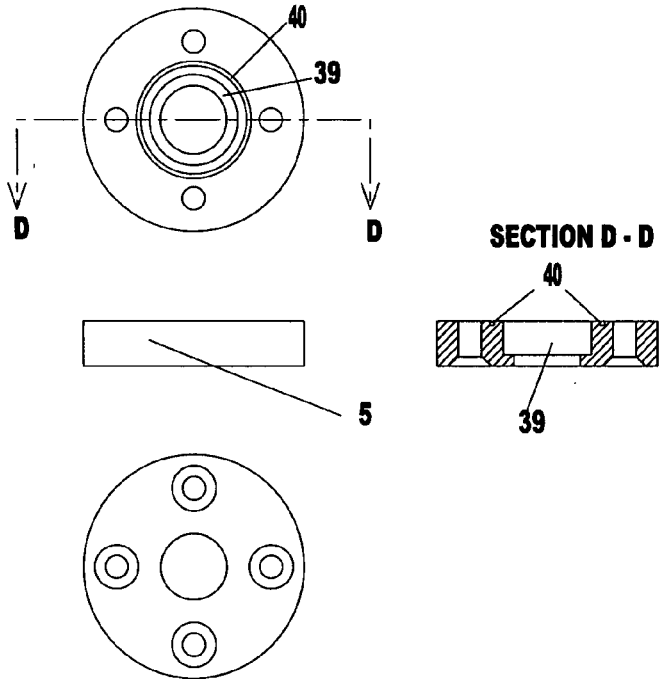
FIG. 7 shows front, top, bottom and cross section views of valve bottom cap 5. Piston bore 39 and seal ring groove 40 are illustrated in the top and cross section views.

FIG. 4 details valve body 25, which is the main housing of the electro-hydraulic valve actuator assembly 1. Anti-rotation pin slot 26 is machined axially into the wall of motor stator bore 29. Electrical connector seat 27 provides the locating and seating surface on valve body 25 for electrical connector 3. Electrical connector 3 is the means of providing electrical power and control signals into valve body 25. The electrical connector 3 is required to seal against the internal hydraulic pressure of the valve as well as sufficiently isolate conductors such that electrical conduction through hydraulic fluid does not occur. Commercial hermetic connectors are available for this purpose, with varying methods of attachment to valve body 25. Wiring passage 28 provides the route through valve body 25 by which electrical connector 3 wiring is routed to stator assembly 14. Piston bore 30 serves to hold piston 6 and also contains the hydraulic fluid during the GEV open period. Rotary valve bushing bore 31 serves to hold bushing—rotary valve 15. The threaded bolt holes—top cap fasteners 32 are for threading in top cap fasteners—socket head cap screws 4. The threaded holes—bottom cap fasteners 33 are for threading in bottom head fastener—flat head cap screw 7. FIG. 7 shows front, top, bottom views and cross section D-D of valve bottom cap 5. Piston bore 39 and seal ring groove 40 are illustrated in the top view and cross section D-D. Valve bottom cap 5 is fastened to valve body 25 by four flat head cap screws 7. Piston 6 provides the linear reciprocating motion by which the electro-hydraulic valve actuator assembly 1 opens and closes valve-poppet 50 for intake and exhaust of the cylinder gasses (shown in FIG. 14). Hydraulic fluid intake port 9 and hydraulic fluid exhaust port 10 provide the means of supplying hydraulic pressure and flow into and out of electro-hydraulic valve actuator assembly 1. Locating groove 11 provides the means of locating electro-hydraulic valve actuator assembly 1 in respect to the valve-poppet 50.

One of ordinary skill in the art will recognize that electro-hydraulic valve actuator assembly 1 can be constructed in a variety of ways and the foregoing is intended only to serve as an example of many satisfactory means of constructing the present invention. For instance, valve top cap 2, valve bottom cap 5 and valve body 25 could be welded instead of bolted together, and a bolted flange could replace locating groove 11.

Figure 2:
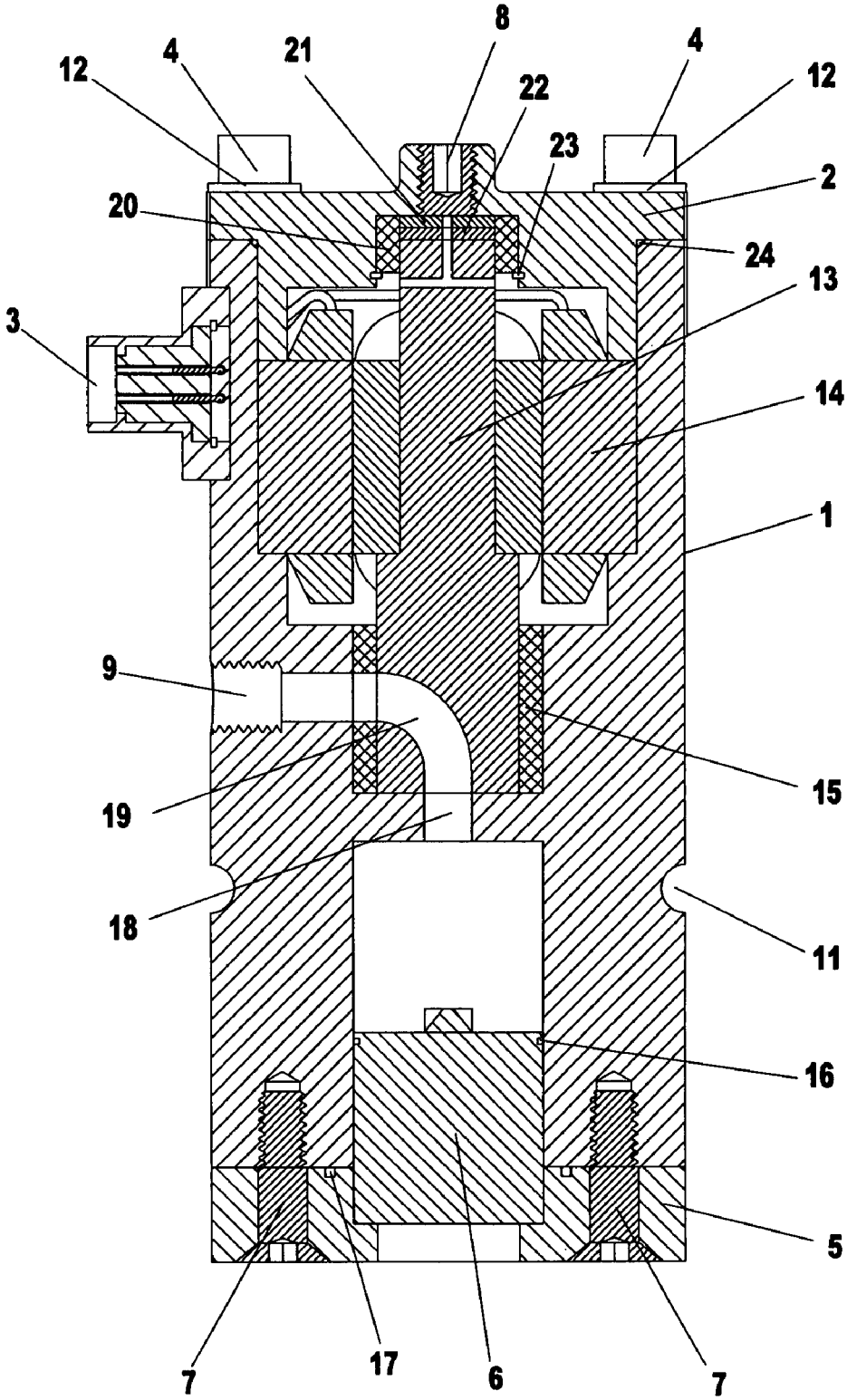
FIG. 2 is cross section A-A of FIG. 1 showing stator assembly 14 and rotor assembly 13—which is rotated by the revolving magnetic field generated by stator assembly 14. Rotor assembly 13 is shown oriented in the position open to the hydraulic fluid inlet port 9 providing hydraulic pressure and flow first through the hydraulic passage-rotary valve 19 then through the hydraulic passage-internal 18 to piston 6. Piston 6 is forced by hydraulic pressure and flow to move away from the hydraulic passage 18 and toward valve bottom cap 5—thus providing a linear actuating force along the axis of travel. Concurrently, the rotor assembly 13 blocks hydraulic pressure and flow to the hydraulic fluid outlet port 10.

FIG. 2 shows cross section A-A of FIG. 1, electro-hydraulic valve actuator assembly 1 illustrating stator assembly 14 and rotor assembly 13 which is rotated by the revolving magnetic field generated by stator assembly 14—which, as illustrated, is functioning as a two phase synchronous electric motor. Rotor assembly 13 is shown oriented in the open position to hydraulic fluid inlet port 9 providing hydraulic pressure and flow first through hydraulic passage-rotary valve 19 then through hydraulic passage 18 to piston 6. Piston 6 is forced by hydraulic pressure and flow to move along, piston bore 30 (see FIG. 4) away from hydraulic passage 18 and toward valve bottom cap 5—thus providing a linear actuating force along the axis of travel to an external member (valve cap etc.) in contact with piston 6 external face.

Figure 11:
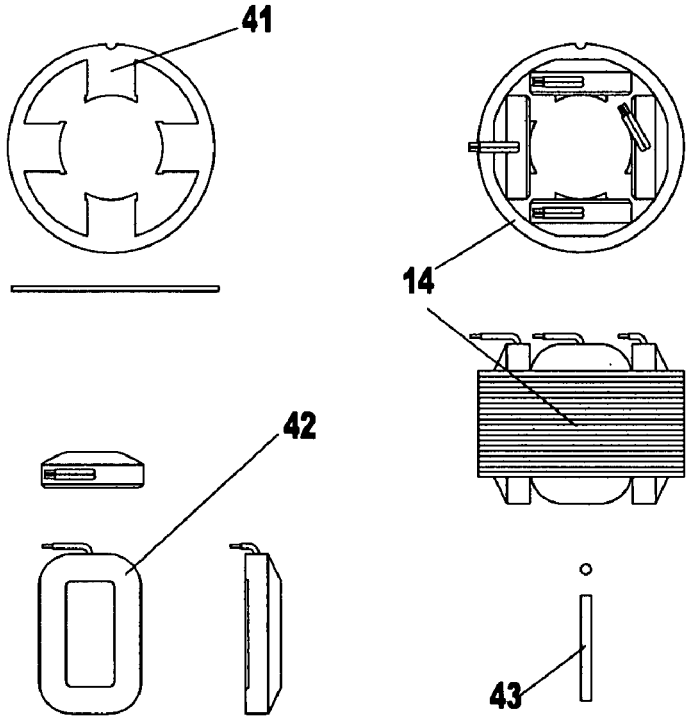
FIG. 11 shows front and top views of stator 14. It can be seen that stator 14 consists of magnetic metal laminations 41 and insulated wire coils 42.

Electrical connector 3 is connected to an external control and power source (not shown) and is internally electrically wired to stator assembly 14. Note: Commercial integrated circuits are available for the purpose of providing control and power to stator assembly 14. FIG. 11 shows front and top views of stator 14. It can be seen that the stator consists of a stack of magnetic metal laminations 41 and insulated wire coil 42. These are of typical construction to that used in existing small electric servo motors.

Figure 9:
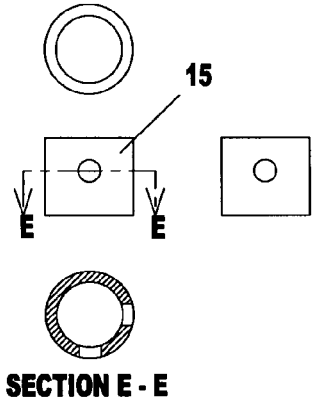
FIG. 9 shows front, top, bottom and cross section views of the bushing—rotary valve, 15 illustrating the position of hydraulic fluid passages.
Figure 12:
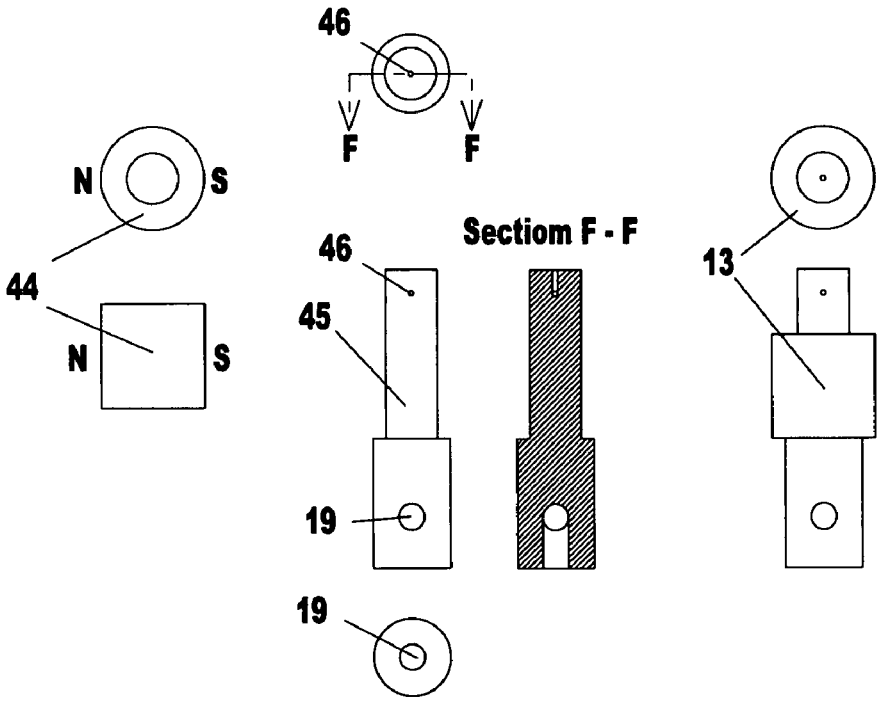
FIG. 12 shows a front and top view of rotor assembly 13. Motor shaft and valve rotor 45 is shown in front, top, bottom and cross section views. Permanent magnet 44 is shown in front and top views.

FIG. 12 shows a front and top view of rotor assembly 13, then front, top, bottom and cross section F-F of motor shaft and integral rotary valve 45, as well as front and top views of permanent magnet 44. Permanent magnet 44 is made from high strength permanent magnet material, preferably with a high temperature rating. Such materials would be commonly known to one of ordinary skill in the art and the choice from available materials is a trade-off between cost and performance for the particular engine requirements. Vent hole 46 is shown in motor shaft and integral rotary valve 45 the purpose of which is to facilitate purging of entrapped air on the initial filling of the hydraulic fluid. It can be seen that rotor assembly 13 is an assembly of permanent magnet 44 and motor shaft and integral rotary valve 45. The fit and assembly of these items is typical of that used in permanent magnet servo motors. Such information would be known to one of ordinary skill in the art and is also available from a variety of texts on motor design. Note the magnetic field orientation of permanent magnet 44. Cross section F-F of motor shaft and integral rotary valve 45 shows hydraulic passage 19. This is illustrated with a round hole as the hydraulic passage. However, this need not be the case and other passage cross sectional geometries may be used to alter the hydraulic fluid flow rate (thus providing different actuator movement profiles)—in conjunction with bushing-rotary valve 15. The hydraulic fluid flow rate alters the actuated GEV rate of travel and/or opening and closing profile. Thus, the control over the rate of rotation and angular position, along with the port geometry, can be used to infinitely vary the valve operating parameters. These parameters are a function of the desired operating characteristics of the specific engine application. Rotor assembly 13 is located and supported at the lower end by bearing bushing-rotary valve 15 (see FIG. 9). The finish and dimensional tolerances of bearing bushing-rotary valve 15 would be those typically found on hydraulic spool valves. Such information would be known to one of ordinary skill in the art and is available from a variety of texts on the subject of hydraulic valve design and in particular on hydraulic servo valve design.

Figure 10:
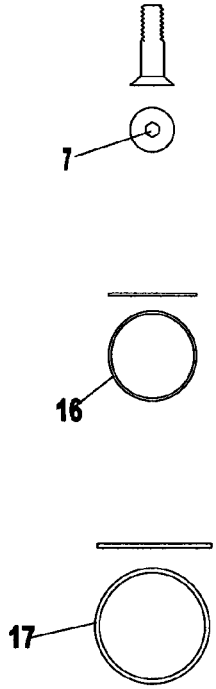
FIG. 10 shows hardware associated with valve bottom cap 5 and piston 6: flat head cap screw 7, piston seal 16, and bottom cap seal ring 17.
Figure 8:
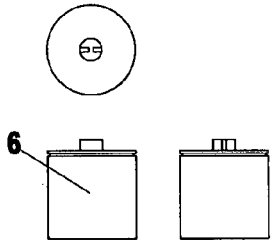
FIG. 8 shows three views of the piston 6 illustrating a seal ring groove and integral snubber.

Referring to FIG. 8, piston 6 has incorporated into the internal (upper) face a boss with a pair of radial slots, the function of which is to act as a hydraulic snubber as the piston 6 reaches the end of the return stroke and the valve 50 seats. This snubbing action provides a so called "soft landing" for the valve 50 as it seats. A person of ordinary skill in the art would recognize that there are a variety of ways to accomplish this snubbing action, in either direction of travel of the piston 6. Referring to FIG. 10, piston seal 16 provides dynamic sealing of piston 6 and bottom cap seal ring 17 provides static sealing of hydraulic pressure to valve bottom cap 5. Piston seal 16 would typically be a conventional hydraulic cylinder lip seal. Sealing ring 17 would typically be an "O" ring. The fit and finish requirements of piston 6 and piston bore 30 are typical of hydraulic pistons and cylinders, which is available from a variety of texts on hydraulic cylinder design and would be known by a person of ordinary skill in the art.

Figure 6:
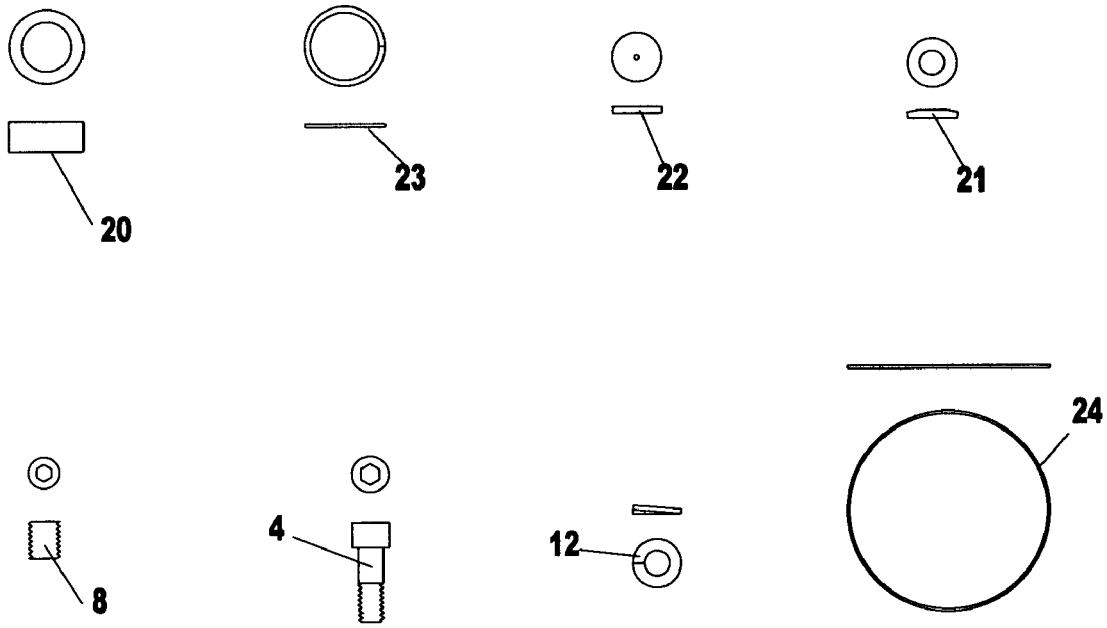
FIG. 6 illustrates hardware items associated with the valve top cap 2: bushing—motor shaft 20, retaining ring 23, thrust washer 22, Belleville washer 21, plug 8, socket head cap screw 4, lock washer 12 and seal ring 24.

Referring to FIG. 6, bearing bushing-motor shaft 20 is retained in valve top cap 2 by retaining ring 23. Belleville washer 21 and thrust washer 22 provide axial thrust on rotor assembly 13. The purpose of this thrust is to hold the rotor assembly 13, in a manner to minimize the clearance between the end of and rotor assembly 13 and actuator body 25—so that leakage of hydraulic fluid from hydraulic passage-rotary valve 19 to the hydraulic fluid outlet port 10 is minimized. Sealing ring-top cap 24 provides sealing of hydraulic pressure for valve top cap 2.

Figure 3:
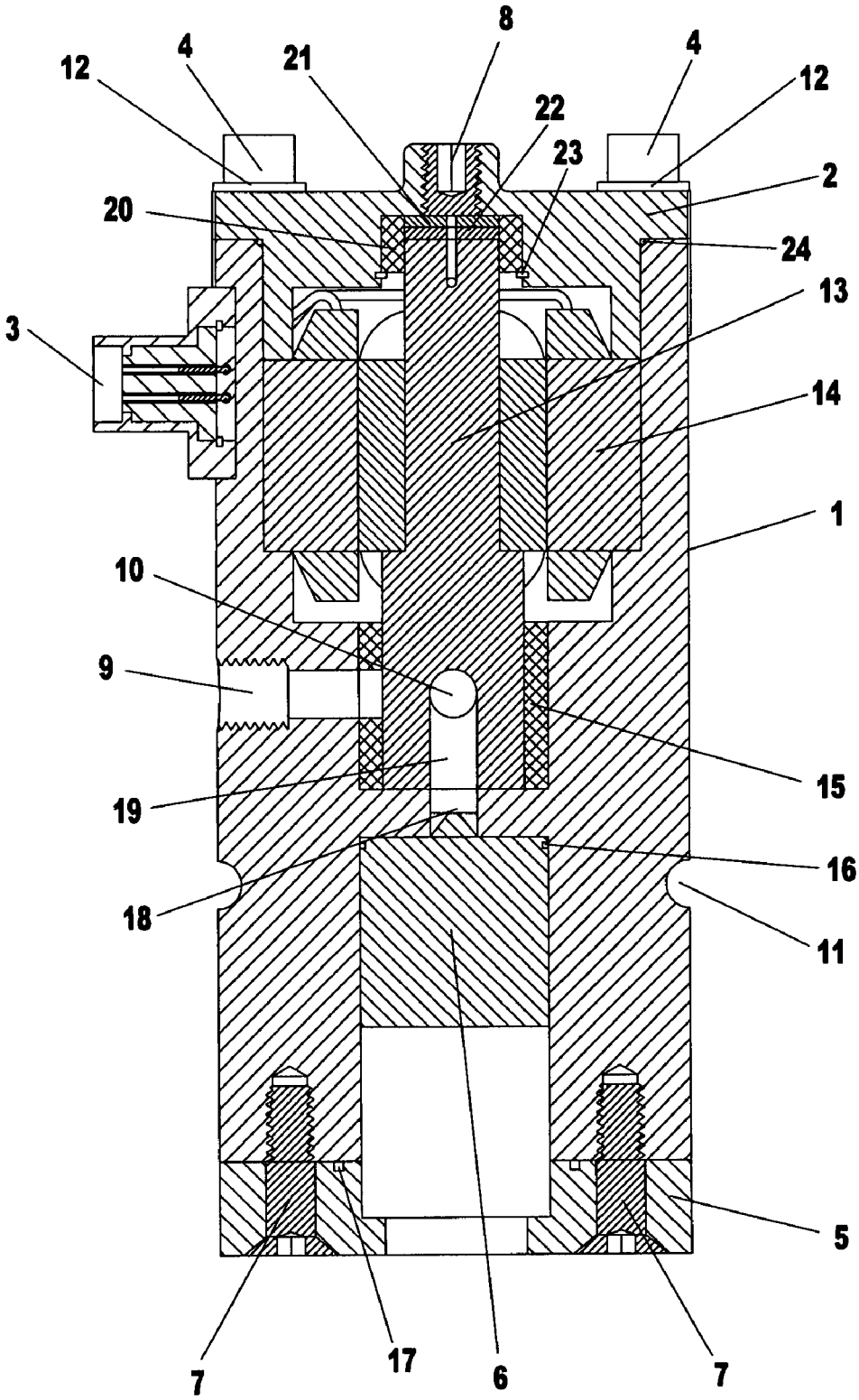
FIG. 3 is cross section A-A of FIG. 1 with rotor assembly 13 shown rotated toward the hydraulic fluid outlet port, 10,—which relieves hydraulic pressure on the piston, 6, allowing it to move away from the valve bottom cap, 5, and return back toward the hydraulic passage—internal, 18. The return travel force is provided by the external GEV spring (not shown) in contact with the external face of the piston 6. Concurrently, rotor assembly 13 blocks hydraulic pressure and flow from the hydraulic fluid inlet port 19.

FIG. 3 is cross section A-A of FIG. 1. It can be seen that rotor assembly 13 is rotated by a revolving magnetic field generated by two phase electrical power created by stator assembly 14—which is electrically wired through electrical connector 3 to an appropriate external electronic control module (of which a number of commercially available devices are suitable). The stator assembly 14 and rotor assembly 13 preferably operate as a two phase servo motor with infinitely variable control over the angular position and rotational speed. A person of ordinary skill in the art would recognize that, alternatively, the motor could also function in the so called "stepper or indexing mode" of rotation. Also, a person of ordinary skill in the art would recognize that, alternatively, a three phase (or more) motor and power source could be utilized in place of the basic two phase motor illustrated. It is appropriate to note that commercial open frame motors are widely available and are quite suitable for the purpose intended herein. Furthermore, alternate motor types, such as the switched reluctance motor, may be utilized.

Referring to FIG. 3, it may be seen that rotor assembly 13 is shown rotated toward hydraulic fluid outlet port 10 which relieves hydraulic pressure on piston 6 de-actuating valve—poppet 50 allowing it to close under pressure from valve spring-coiled 49. Concurrently, rotor assembly 13 also blocks hydraulic pressure and flow from the hydraulic fluid inlet port 9. With valve-poppet 50 (intake or exhaust valve) held in the closed position by valve-poppet 50, the rotation of motor shaft and valve rotor 45 continues at a rate as determined by the external electronic control (not shown) until the hydraulic passage 19 again aligns with hydraulic fluid inlet port 9 and the valve-poppet 50 again opens. Hydraulic fluid inlet port 9 and hydraulic fluid outlet port 10 are shown located ninety degrees apart in valve body 25, thus the speed of rotation of rotor assembly 13 is one half that of the engine speed (similar to a conventional camshaft arrangement). Alternative angular location of the inlet port 9 and outlet port 10 is possible but the 90 degree orientation is preferred as it allows for slower valve rotation (one half engine speed).

Figure 13:
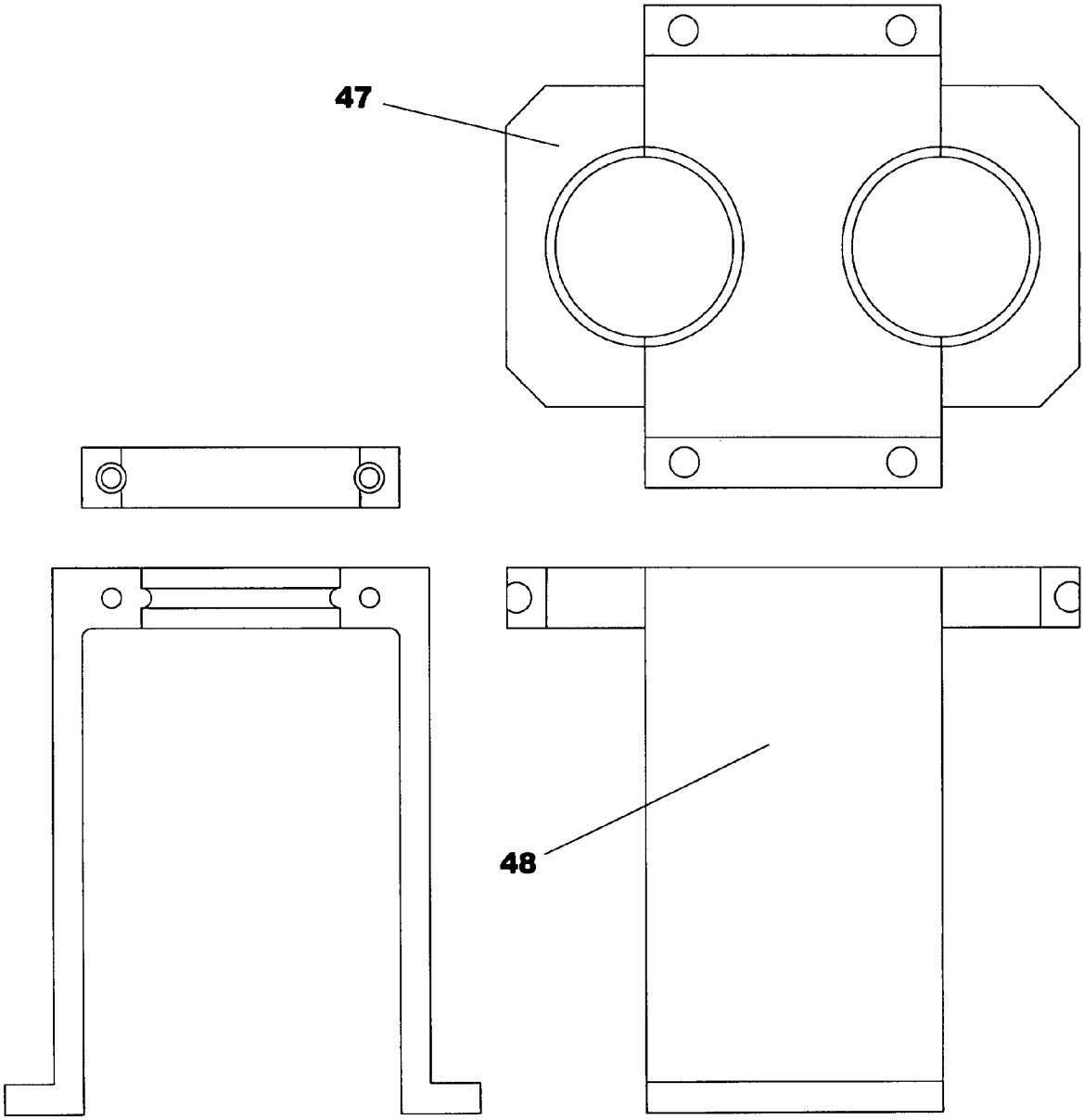
FIG. 13 shows mounting bracket clamp 47 and mounting bracket 48.

FIG. 13 shows mounting bracket clamp 47 and mounting bracket 48 which are suitable for mounting two of the electro-hydraulic valve actuator assembly 1. This provides for valve actuation of a single cylinder of an internal combustion engine. One of ordinary skill in the art would recognize that a wide range of suitable mounting brackets can be developed for a variety of on-engine conditions and that the one shown herein serves only as an example.

Figure 14:
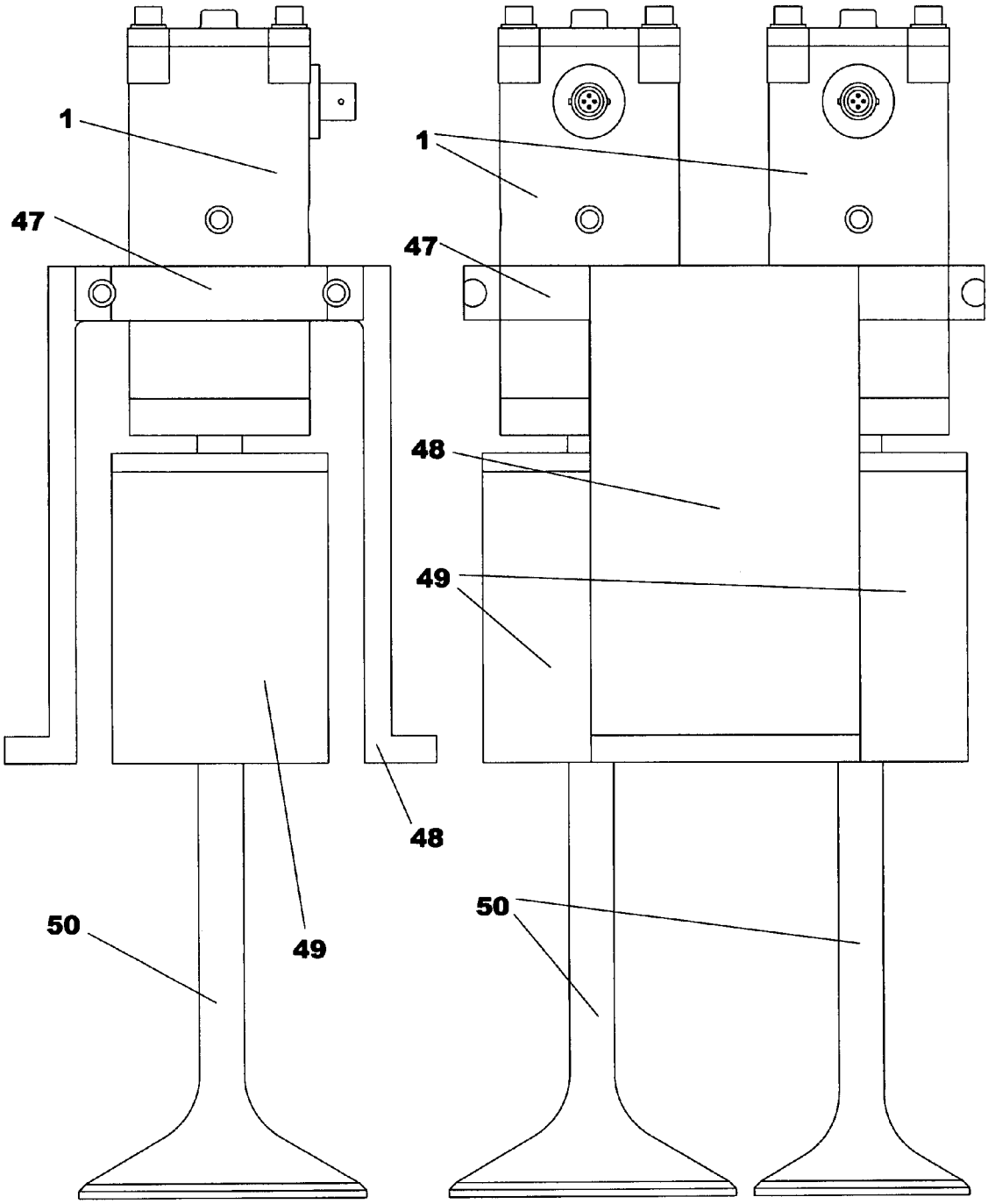
FIG. 14 Mounting bracket 48 and mounting bracket clamp 47 are shown in a front and side view with two of the electro-hydraulic valve actuator assembly 1 installed. Also shown are two of valve spring-coiled 49 and valve-poppet 50 in the relative position of a typical engine cylinder installation.

In FIG. 14 valve spring-coiled 49 and valve-poppet 50 are shown in a front and side view with mounting bracket clamp 47, mounting bracket 48 and two electro-hydraulic valve actuator assemblies 1 which illustrate a typical installation for a single cylinder. Note: The cylinder head to which mounting bracket 48 would be fastened and on which valve-poppet 50 would be located has been omitted for clarity.

Figure 15:
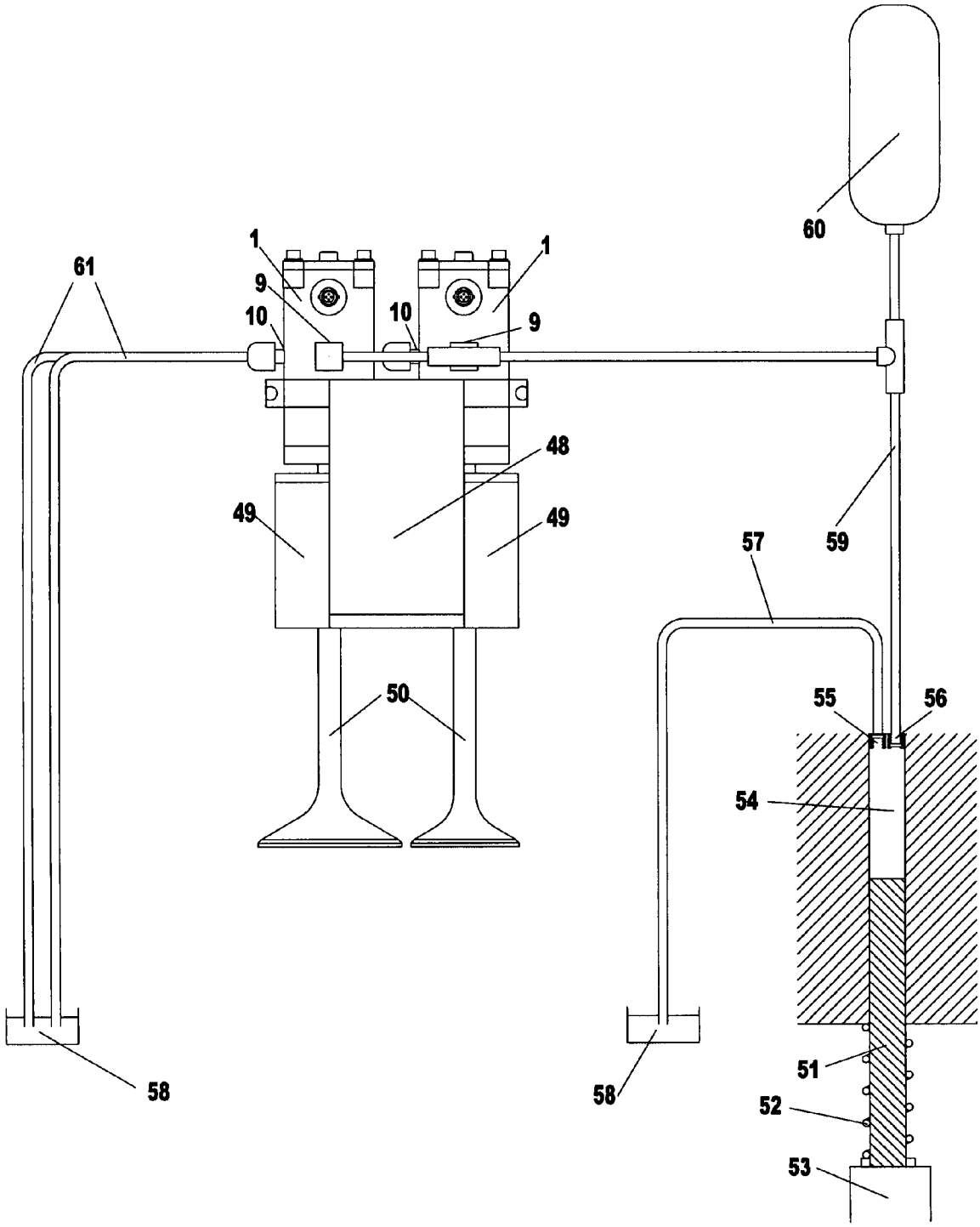
FIG. 15 portrays a typical hydraulic fluid pressure and return circuit for a single cylinder of an internal combustion reciprocating engine with the electro-hydraulic valve actuator assembly 1 providing the opening and closing of the intake and exhaust valves 50. Hydraulic pump piston 51 provides hydraulic power to a pair of electro-hydraulic valve actuator assemblies 1.

Referring to FIG. 15, hydraulic pump piston 51 provides hydraulic power for two electro-hydraulic valve actuator assemblies 1 for actuating valve-poppet 50 for a single cylinder of an engine. Thus, as illustrated, a hydraulic piston pump is required for each cylinder in an engine. The pump cylinder 54 houses the piston 51 and pump inlet valve 55 and pump outlet valve 56. The piston 51 is driven by cam 53 during the output stroke of piston 51. Spring 52 drives the piston 51 during the hydraulic fluid intake stroke of the pump. During the intake stroke, hydraulic fluid is drawn from the hydraulic reservoir 58 through suction line 57 and intake valve 55 by the piston 51. The cams 53, driving all the pump pistons for each cylinder may be on a common shaft driven by a takeoff from the engine shaft or from a separate drive—such as by an electric motor synchronized to the engine speed and piston position. Alternatively the pump pistons 51 may be directly driven by the reciprocating motion of the engine pistons. One skilled in the art would recognize that hydraulic pressure and flow could also be provided by a variety of hydraulic pumps driven in a number of different ways. In the method as shown, hydraulic fluid under pressure is driven out of the cylinder 54 and through outlet valve 56 and into the high pressure lines 59. The timing of the illustrated pump operation is such that the valve actuators are closed during the discharge of hydraulic fluid from the pump. Thus, hydraulic fluid under pressure flows into accumulator 60, where it remains under pressure until it is required to open an engine intake or exhaust valve. When required by an electro-hydraulic valve actuator assembly 1, the hydraulic fluid flows out of the accumulator 60 through high pressure lines 59, then through hydraulic fluid inlet port 9. The high pressure hydraulic fluid drives the actuating piston 6, forcing valve spring 49 to compress and the valve-poppet 50 to open. When the electro-hydraulic valve actuator assembly 1, moves to the close position (by the rotor assembly 13, turning such that hydraulic passage-rotary valve 19, aligns with outlet port 10), the hydraulic fluid in the valve discharges through the outlet port 10, where it then flows through the return lines 61 to the hydraulic fluid reservoir 58.

One of ordinary skill in the art would recognize that the invention herein disclosed can be implemented over a wide range of size and capacity to suite the requirements of a wide range of engine types and size. Further, one of ordinary skill in the art would readily recognize that suitable material and components must be selected for the specific on-engine operating conditions, with particular attention to the temperature and chemical environmental properties. Additionally, one of ordinary skill in the art would foresee that piston 6 could be arranged other than co-axially with rotor assembly 13, as shown herein, and that a wide variety of configurations is possible. One skilled in the art would also recognize that multiple electro-hydraulic valve actuator assemblies 1 could be installed in one housing for a single engine cylinder. Also, one of ordinary skill in the art would readily recognize that alternate types of valve springs, such as pneumatic or magnetic springs, could be employed and in addition, valve springs of varying types could be made integral within electro-hydraulic valve actuator assembly 1.

What is claimed is:

1. An actuator for operation of an internal combustion reciprocating engine gas exchange poppet valve, comprising:

a linear acting hydraulic cylinder arranged to actuate said gas exchange poppet valve;

a rotary valve for directing hydraulic fluid pressure and flow into and out of said linear acting hydraulic cylinder;

ports and means of passage in said rotary valve for conveying said hydraulic fluid flow;

an electric motor for driving said rotary control valve;

a housing for containing said linear acting hydraulic cylinder, said rotary valve and said electric motor;

ports and means of passage in said housing for conveying hydraulic pressure and flow in and out of said actuator and to and from said rotary valve;

an electrical connector in said housing for conducting electrical power and electronic signals in an out of said housing; and, a means of mounting said housing adapted to affect the actuation of said internal combustion reciprocating engine gas exchange valve.

2. The actuator of claim 1 wherein said linear acting hydraulic cylinder, said rotary valve and said electric motor are arranged in line within said housing.

3. The actuator of claim 2 wherein the hydraulic cylinder is of a single acting configuration.

4. The actuator of claim 1 wherein the hydraulic cylinder is of a single acting configuration.

* * * * *